US011021954B2

(12) United States Patent
Zhou et al.

(10) Patent No.: US 11,021,954 B2
(45) Date of Patent: Jun. 1, 2021

(54) METHOD OF RECOVERING ROOM-AND-PILLAR COAL PILLAR BY USING EXTERNAL REPLACEMENT SUPPORTS

(71) Applicant: CHINA UNIVERSITY OF MINING AND TECHNOLOGY, Jiangsu (CN)

(72) Inventors: Nan Zhou, Jiangsu (CN); Hengfeng Liu, Jiangsu (CN); Meng Li, Jiangsu (CN); Zhongya Wu, Jiangsu (CN); Jixiong Zhang, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 16/763,426

(22) PCT Filed: Feb. 22, 2019

(86) PCT No.: PCT/CN2019/075861
§ 371 (c)(1),
(2) Date: May 12, 2020

(87) PCT Pub. No.: WO2020/048094
PCT Pub. Date: Mar. 12, 2020

(65) Prior Publication Data

US 2020/0318480 A1 Oct. 8, 2020

(30) Foreign Application Priority Data

Sep. 4, 2018 (CN) ..... 201811027255.1

(51) Int. Cl.
*E21C 41/18* (2006.01)
*E21F 15/02* (2006.01)
*E21D 15/48* (2006.01)

(52) U.S. Cl.
CPC ..... *E21C 41/18* (2013.01); *E21F 15/02* (2013.01); *E21D 15/483* (2013.01)

(58) Field of Classification Search
CPC ..... E21F 15/02; E21C 41/18
See application file for complete search history.

(56) References Cited

U.S. PATENT DOCUMENTS 3,525,551 A * 8/1970 Mallander ..... E21C 41/18 299/11
3,999,804 A 12/1976 Simpson
(Continued)

FOREIGN PATENT DOCUMENTS

CN 101737068 A 6/2010
CN 105240014 A 1/2016
(Continued)

OTHER PUBLICATIONS

International Search Report dated Jun. 14, 2019 from corresponding International Patent Application No. PCT/CN2019/075861, 7 pages.
(Continued)

*Primary Examiner* — Janine M Kreck
(74) *Attorney, Agent, or Firm* — Ohlandt, Greeley, Ruggiero & Perle, L.L.P.

(57) ABSTRACT

A method of recovering a room-and-pillar coal pillar by using external replacement supports. In the recovery of a room-and-pillar coal pillar, a cement material wall is formed by performing pouring around a coal pillar having a width to height ratio of less than 0.6, by means of a single-pillar sack arrangement technique, such that a coal pillar resource may be mined while a wall made from a cement filling material supports an overlying stratum. After mining is complete, a coal pillar goaf region is filled with the cement filling material, and after the cement filling material solidifies and is stable, the single pillar can be recovered.

6 Claims, 3 Drawing Sheets

(56) References Cited

U.S. PATENT DOCUMENTS

| | | | | |
|---|---|---|---|---|
| 4,198,097 | A * | 4/1980 | Fondriest | E21C 41/18 299/11 |
| 4,378,132 | A * | 3/1983 | Spies | E21F 7/00 299/11 |

FOREIGN PATENT DOCUMENTS

| | | | |
|---|---|---|---|
| CN | 106869994 | A | 6/2017 |
| CN | 109113744 | A | 1/2019 |
| SU | 576411 | A | 10/1977 |
| WO | 2015/056201 | A1 | 4/2015 |

OTHER PUBLICATIONS

Written Opinion dated Jun. 14, 2019 from corresponding International Patent Application No. PCT/CN2019/075861, 4 pages.

* cited by examiner (a) Schematic of Supporting Structure of Reserved Coal Pillar (b) Simplified Mechanical Model

METHOD OF RECOVERING ROOM-AND-PILLAR COAL PILLAR BY USING EXTERNAL REPLACEMENT SUPPORTS

BACKGROUND

1. Field of the Disclosure

The present disclosure belongs to the technical field of coal pillar recovery, in particular to a method for recovering room-type coal pillars by replacing with external supports, which is especially applicable to recovering room-type coal pillars with width-to-height ratio less than 0.6, which are left in a coal mine after coal mining, by replacing with supports.

2. Discussion of the Background Art

Room-type coal pillar mining is widely applied in the northwest region of China, mainly in mine fields in Shanxi, Inner Mongolia, Shaanxi and other provinces where resources are widely distributed, geological structures are simple and coal seams are shallow. The room-type coal pillar mining method has advantages including low production cost, high efficiency and easy management. However, the coal recovery rate is low, and the coal pillars have a risk of chained instability that may lead to disasters. Safe recovery of room-type coal pillars can improve the utilization of coal resources and prevent serious disasters and accidents caused by instability of the coal pillars.

Traditional coal pillar recovery methods used in China include split pillar recovery and bin wing recovery, which have low efficiency and low degree of mechanization; however, the existing coal pillar filling recovery methods, such as comprehensive mechanized filling recovery and material-throwing filling recovery, are difficult to be widely applied owing to heavy input of equipment and filling material.

Therefore, it is an urgent major task to develop an innovative, safe, efficient and economical room-type coal pillar recovery method.

SUMMARY

In order to realize the safe, efficient and low-cost recovery of coal pillars left after room-type mining, the disclosure provides a method for recovering room-type coal pillars by replacing with external supports, which is easy to operate and with a high resource recovery rate.

In order to realize the object described above, the technical scheme employed by the present disclosure is as follows.

The method for recovering room-type coal pillars by replacing with external supports in the present disclosure comprises the following steps: in the process of recovering a room-type coal pillar with width-to-height ratio less than 0.6, casting a cement filling material wall within a certain width range around the room-type coal pillar by hanging bags on a single prop, mining the room-type coal pillar resource under a condition of supporting the overlaying strata with the cement filling material wall, filling the goaf area of the room-type coal pillar with a cement filling material after the mining is completed, and recovering the single prop after the cement filling material is solidified and stabilized.

A method for recovering room-type coal pillars by replacing with external supports comprises the following steps:

1) casting a cement filling material wall around a room-type coal pillar by hanging bags on a single prop, and reserving a gap in the cement filling material wall;

2) mining the internal room-type coal pillar through the gap in the cement filling material wall, under a condition of supporting the overlaying strata with the cement filling material wall;

3) plugging the gap in the cement filling material wall and filling a cement filling material into the goaf area surrounded by the cement filling material wall, after the mining of the room-type coal pillar is completed;

4) recovering the single prop after the cement filling material is solidified and stabilized.

Furthermore, the width-to-height ratio of the room-type coal pillar is less than 0.6.

Furthermore, in the step 1), a mechanical model for the stage in which the overlaying strata is supported solely by the cement filling material wall is established on the basis of the Winkler beam theory, to obtain the displacement and stress condition of the roof in the supporting stage by the cement filling material wall; and the theoretical casting width of the cement filling material wall is obtained according to a first strength theory of roof and a determination criterion for the ultimate strength of the cement filling material wall.

Furthermore, the width of the cement filling material wall is calculated through the following procedures:

a. sectioning a half plane of the room-type coal pillar for analysis, setting the load of the overlaying strata on the roof as a uniformly distributed load q, the foundation coefficient of the cement filling material wall as k, the spacing between adjacent small room-type coal pillars as c, the width of the cement filling material wall as b, the width of the room-type coal pillar as a and the total width of the room-type coal pillars as 2a, and the differential equation of deflection curve for the segments of the roof in the analyzed area is as follows:

$$\begin{cases} EI\dfrac{d^4\omega_1(x)}{dx^4} = q & x \in [0, a] \\ EI\dfrac{d^4\omega_2(x)}{dx^4} = q - k\omega_2(x) & x \in [a, a+b] \\ EI\dfrac{d^4\omega_3(x)}{dx^4} = q & x \in [a+b, a+b+c] \end{cases} \quad \text{(i)}$$

where, EI—flexural rigidity, N/m;

x—distance from any point on the foundation surface to the origin of coordinates in the half plane, m;

$\omega_1(x)$, $\omega_2(x)$, $\omega_3(x)$—deflections of the roof when x is in the segments [0, a], [a, a+b], [a+b, a+b+c] respectively, m;

b. solving the equation (i) by setting $$\alpha = \sqrt[4]{\frac{k}{4EI}},$$

to obtain a deflection curve equation of the roof:

$$\begin{cases} \omega_1(x) = \frac{q}{24EI}x^4 + d_1x^3 + d_2x^2 + d_3x + d_4 \\ \omega_2(x) = \frac{q}{k} + d_5e^{-\alpha x}\cos(\alpha x) + d_6e^{-\alpha x}\sin(\alpha x) + \\ \quad d_7e^{\alpha x}\cos(\alpha x) + d_8e^{\alpha x}\sin(\alpha x) \\ \omega_3(x) = \frac{q}{24EI}x^4 + d_9x^3 + d_{10}x^2 + d_{11}x + d_{12} \end{cases} \quad \text{(ii)}$$

where, $d_1$, $d_2$, $d_3$, . . . , $d_{12}$—constant coefficients;

the parameters $d_1$~$d_{12}$ can be obtained according to the condition of continuity and the symmetric boundary condition of the model;

c. obtaining a bending moment equation of the roof by solving the above equations:

$$\begin{cases} M_1(x) = -EI\frac{d^2\omega_1}{dx_2} \\ M_2(x) = -EI\frac{d^2\omega_2}{dx_2} \\ M_3(x) = -EI\frac{d^2\omega_3}{dx_2} \end{cases} \quad \text{(iii)}$$

where, $M_1(x)$, $M_2(x)$, $M_3(x)$—the bending moments of the roof when x is in the segments [0, a], [a, a+b], [a+b, a+b+c] respectively, m;

the reserved width b of the cement filling material wall shall meet the first strength theory of roof and the ultimate strength theory of roof at the same time, i.e., it shall be greater than or equal to a minimum reserved width $b_1$ under the first strength theory of roof and a minimum reserved width $b_2$ under the ultimate strength theory of roof at the same time; specifically, the reserved width b is determined through the following steps d and e:

d. simplifying the roof as a simply supported beam subjected to a uniformly distributed load q on the top and a support load applied in width $b_1$ on the bottom; through analysis, it shows that the maximum bending moment $M_{max}$ suffered by the roof occurs at the side at the center of the beam span offsetting from the bottom support load, at a distance $x_m=a+b_1+3EI\cdot d_9/q$ from the origin of the model, and calculating its value from $M_3(x_m)$ in the equation (iii); then, according to a rectangular section beam theory, calculating the maximum tensile stress of the roof as follows:

$$\sigma_{max} = \frac{6M_{max}}{h^2} \quad \text{(iv)}$$

where, h—height of the roof, m;

according to the first strength theory of roof, in order to prevent the roof from broken, the following criterion should be met:

$$\sigma_{max} \leq [\sigma_t] \quad \text{(v)}$$

where, $[\sigma_t]$—allowable tensile stress on the roof, MPa;

The spacing c between adjacent room-type coal pillars and the width 2a of the room-type coal pillars are known, the minimum reserved width $b_1$ of the reserved coal pillar under the first strength theory of roof can be obtained according to the criterion in the expression (v);

e. besides, the width $b_2$ of the cement filling material wall shall be enough to prevent the cement filling material wall from broken under the ultimate strength theory; thus, according to the ultimate strength theory, the following criterion should be met:

$$\sigma F \leq \sigma_P \quad \text{(vi)}$$

where, σ—force acting on the filling material wall $\sigma=k\int_a^{a+b}\omega_2(x)dx$, m;

k—safety factor, determined as 2;

$\sigma_p$—ultimate strength of the cement filling material wall, MPa;

the minimum reserved width $b_2$ of the cement filling material wall under the ultimate strength theory is calculated on the basis of the expression (vi);

f. calculating the reserved width b of the cement filling material wall as $b=\max\{b_1, b_2\}$.

Furthermore, in the step 2), the room-type coal pillar is mined with a continuous coal miner, and the mined coal is transported by means of a forklift truck to a belt conveyer and then conveyed by the belt conveyer out of the mining area.

Furthermore, in the step 3), the gap in the cement filling material wall is plugged by building a plugging wall, and the cement filling material is pumped by means of a filling pump through a pumping opening reserved in the plugging wall into the goaf area surrounded by the cement filling material wall for filling.

Beneficial Effects the method for recovering room-type coal pillars by replacing with external supports provided in the present disclosure has the following advantages over the prior art: the method provided in the present disclosure is especially applicable to safe, efficient and low-cost recovery of coal pillars with width-to-height ratio less than 0.6, which are left in room-type coal mining. The method for recovering room-type coal pillars by replacing with external supports utilizes a cement filling material to support the overlaying strata in replacement of the original coal pillars, has better supporting performance than the original coal pillars, is more advantageous for maintaining stability of overlaying strata in the room-type coal pillar area, can prevent the coal seam from spontaneous ignition and water flowing fractures from rising, and thereby can protect the overlaying water bearing strata and the ecological environment on the ground surface. The present disclosure is reliable, safe and economic, and has wide application prospects.

In the figures: 1—room-type coal pillar; 2—single prop; 3—cement filling material wall; 4—cement filling material; 5—gap in cement filling material wall; 6—plugging wall; 7—continuous coal miner; 8—forklift truck; 9—belt conveyer.

DETAILED DESCRIPTION OF THE PREFERRED EMBODIMENT

The present disclosure discloses a method for recovering room-type coal pillars by replacing with external supports, which comprises: in the process of recovering a room-type coal pillar, casting a cement filling material wall around the room-type coal pillar with width-to-height ratio less than 0.6 by hanging bags on a single prop, mining the room-type coal pillar resource under a condition of supporting the overlaying strata with the cement filling material wall, filling the goaf area of the room-type coal pillar with the cement filling material after the mining is completed, and recovering the single prop after the cement filling material is solidified and stabilized. A mechanical model for the stage in which the overlaying strata is supported solely by the cement filling material wall is established on the basis of the Winkler beam theory, to obtain the displacement and stress condition of the roof in the supporting stage by the cement filling material wall. The theoretical casting width of the cement filling material wall is obtained according to a first strength theory of roof and a determination criterion for the ultimate strength of the cement filling material wall. The method can effectively recover coal pillars left in room-type coal mining, reduce waste of coal resource, maintain stability of the overlaying strata above the coal pillar and avoid the occurrence of a series of safety problems.

Hereunder the present disclosure will be further described in detail with reference to the drawings and embodiments.

Figure 1:
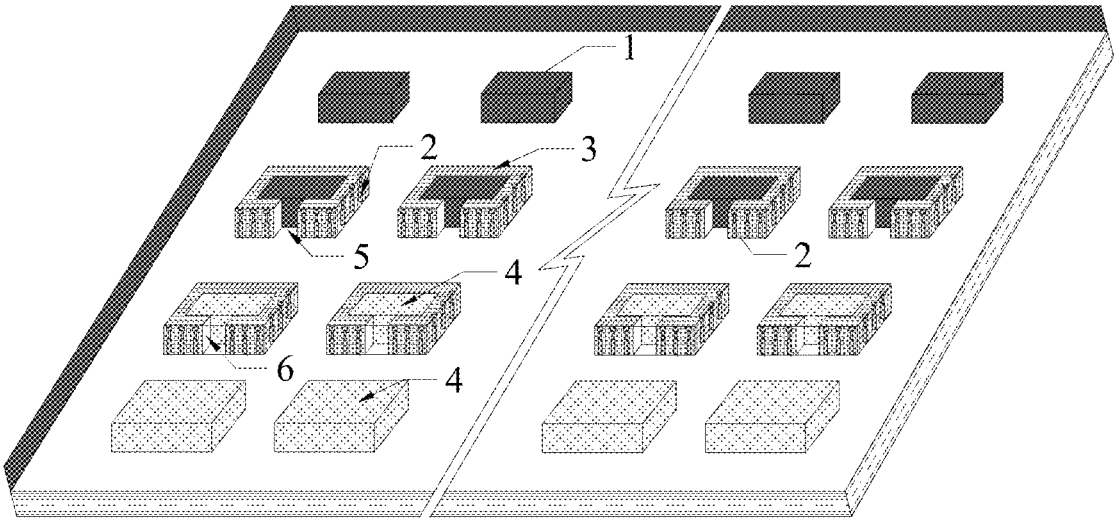
FIG. 1 is a layout plan view of the coal mining face according to the present disclosure.
Figure 2:
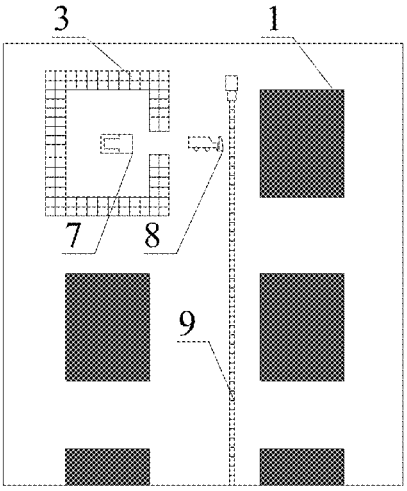
FIG. 2 is a plan view in the state of recovering a room-type coal pillar by replacing with an external support according to the present disclosure.

In the method for recovering room-type coal pillars by replacing with external supports provided in the present disclosure, as shown in the layout plan view of a coal mining face in FIG. 1, in the process of recovery of room-type coal pillars with width-to-height ratio greater than 0.6, a cement filling material wall (3) is cast within a certain width range around a room-type coal pillar (1) according to the result of calculation based on a mechanical model in the stage of supporting the overlaying strata with the cement filling material wall (3), a gap (5) is reserved in the cement filling material wall as shown in FIG. 2, the room-type coal pillar (1) is mined out with a continuous coal miner (7) after the cement filling material wall (3) is solidified and stabilized, and the mined coal is transported by means of a forklift truck (8) to a belt conveyer (9), and then conveyed on the belt conveyer (9) out of the mining area; after the mining is completed, a plugging wall (6) is built to plug the gap (5) in the cement filling material wall, and the goaf area is filled with a cement filling material (4); after the cement filling material (4) is solidified and stabilized, the single prop (2) is recovered and used for the mining of the next room-type coal pillar (1).

Figure 3:
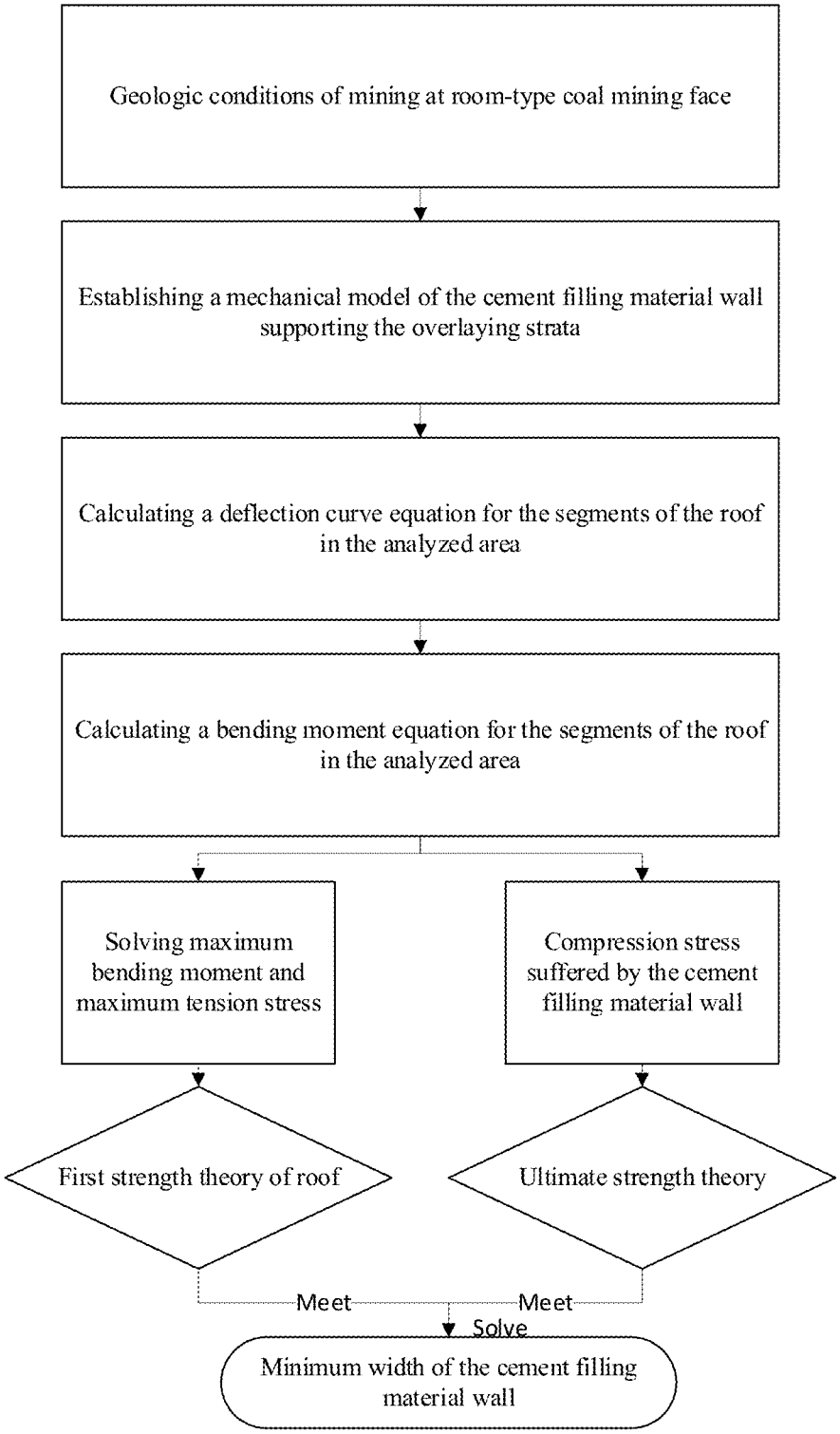
FIG. 3 is a flow chart of calculating the width of reserved coal pillar according to the present disclosure.
Figure 4:
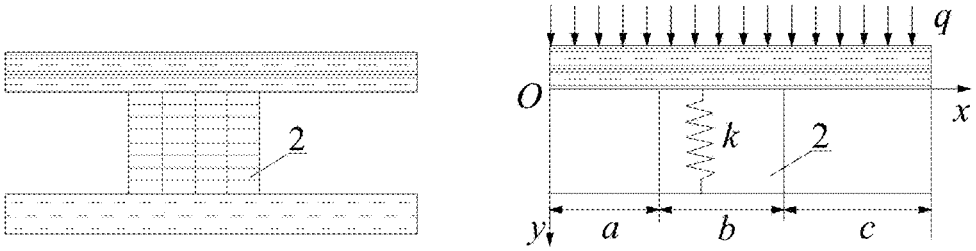
FIG. 4 shows the mechanical model of the cement filling material wall in the stage of supporting overlaying strata according to the present disclosure.

As shown in FIG. 3, the width of the cement filling material wall (3) is calculated through the following procedures:

a. sectioning a half plane of the room-type coal pillar (1) for analysis; according to the mechanical model of the cement filling material wall in the stage of supporting overlaying strata as shown in FIGS. 4(*a*) and 4(*b*), setting the load of the overlaying strata on the roof as a uniformly distributed load q, the foundation coefficient of the cement filling material wall (3) as k, the spacing between adjacent small room-type coal pillars (1) as c, the width of the cement filling material wall (3) as b, the width of the room-type coal pillar (1) as a and the total width of the room-type coal pillars as 2a, and the differential equation of deflection curve for the segments of the roof in the analyzed area is as follows:

$$\begin{cases} EI\dfrac{d^4\omega_1(x)}{dx^4} = q & x \in [0, a] \\ EI\dfrac{d^4\omega_2(x)}{dx^4} = q - k\omega_2(x) & x \in [a, a+b] \\ EI\dfrac{d^4\omega_3(x)}{dx^4} = q & x \in [a+b, a+b+c] \end{cases} \quad \text{(i)}$$

where, EI—flexural rigidity, N/m;

x—distance from any point on the foundation surface to the origin of coordinates in the half plane, m;

$\omega_1(x)$, $\omega_2(x)$, $\omega_3(x)$—deflections of the roof when x is in the segments [0, a], [a, a+b], [a+b, a+b+c] respectively, m;

b. solving the equation (i) by setting $$\alpha = \sqrt[4]{\frac{k}{4EI}},$$

to obtain a deflection curve equation of the roof:

$$\begin{cases} \omega_1(x) = \dfrac{q}{24EI}x^4 + d_1x^3 + d_2x^2 + d_3x + d_4 \\ \omega_2(x) = \dfrac{q}{k} + d_5e^{-\alpha x}\cos(\alpha x) + d_6e^{-\alpha x}\sin(\alpha x) + \\ \qquad d_7e^{\alpha x}\cos(\alpha x) + d_8e^{\alpha x}\sin(\alpha x) \\ \omega_3(x) = \dfrac{q}{24EI}x^4 + d_9x^3 + d_{10}x^2 + d_{11}x + d_{12} \end{cases} \quad \text{(i)}$$

where, $d_1$, $d_2$, $d_3$, $d_4$, . . . , $d_{12}$—constant coefficients;

the parameters $d_1$~$d_{12}$ can be obtained according to the condition of continuity and the symmetric boundary condition of the model;

c. obtaining a bending moment equation of the roof:

$$\begin{cases} M_1(x) = -EI\dfrac{d^2\omega_1}{dx_2} \\ M_2(x) = -EI\dfrac{d^2\omega_2}{dx_2} \\ M_3(x) = -EI\dfrac{d^2\omega_3}{dx_2} \end{cases} \quad \text{(iii)}$$

where, $M_1(x)$, $M_2(x)$, $M_3(x)$—the bending moments of the roof when x is in the segments [0, a], [a, a+b], [a+b, a+b+c] respectively, m;

the width b of the cement filling material wall (3) shall meet the first strength theory of roof and the ultimate strength theory of roof at the same time, i.e., it shall be greater than or equal to a minimum reserved width $b_1$ under the first strength theory of roof and a minimum reserved width $b_2$ under the ultimate strength theory of roof at the same time; specifically, the reserved width b is determined through the following steps d and e:

d. simplifying the roof as a simply supported beam subjected to a uniformly distributed load q on the top and a support load applied in width $b_1$ on the bottom; through analysis, it shows that the maximum bending moment $M_{max}$ suffered by the roof occurs at the side at the center of the beam span offsetting from the bottom support load, at a distance ($x_m=a+b_1+3EI\cdot d_9/q$) from the origin of the model, and calculating its value from $M_3(x_m)$ in the equation (iii); then, according to a rectangular section beam theory, calculating the maximum tensile stress of the roof as follows:

$$\sigma_{max} = \frac{6M_{max}}{h^2} \tag{iv}$$

where, h—height of the roof, m;

according to the first strength theory of roof, in order to prevent the roof from broken, the following criterion should be met:

$$\sigma_{max} \leq [\sigma_t] \tag{v}$$

where, $[\sigma_t]$—allowable tensile stress on the roof, MPa;

the spacing c between adjacent room-type coal pillars (1) and the width 2a of the room-type coal pillars are known, the minimum reserved width $b_1$ of the reserved coal pillar (2) under the first strength theory of roof can be obtained according to the criterion in the expression (v);

e. besides, the minimum reserved width $b_2$ of the cement filling material wall (3) under the ultimate strength theory shall be enough to prevent the cement filling material wall (3) from broken; thus, according to the ultimate strength theory, the following criterion should be met:

$$\sigma F \leq \sigma_P$$

where, σ—force $\sigma=k\int_a^{a+b}\omega_2(x)dx$ acting on the filling material wall, m;

k—safety factor, determined as 2;

$\sigma_p$—ultimate strength of the cement filling material wall, MPa.

The minimum reserved width $b_2$ of the cement filling material wall (3) under the ultimate strength theory is calculated on the basis of the expression (vi).

Finally, the actual reserved width b of the cement filling material wall (3) is calculated as $b=\max\{b_1, b_2\}$.

EXAMPLE

Figure 5:
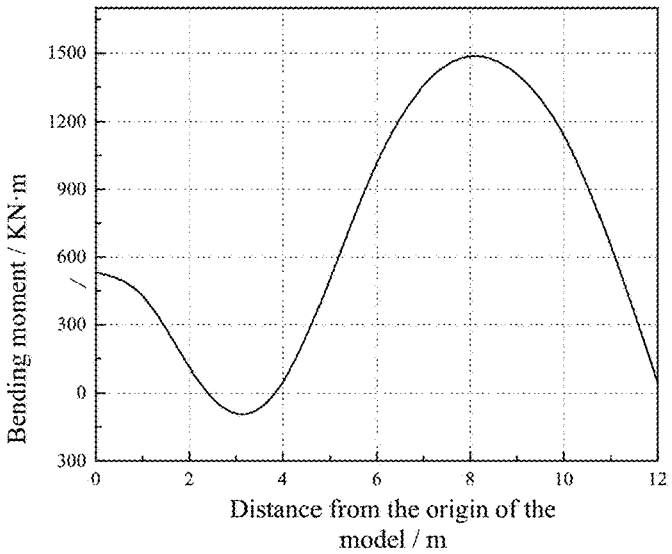
FIG. 5 is a distribution chart of bending moment of the roof according to the present disclosure.
Figure 6:
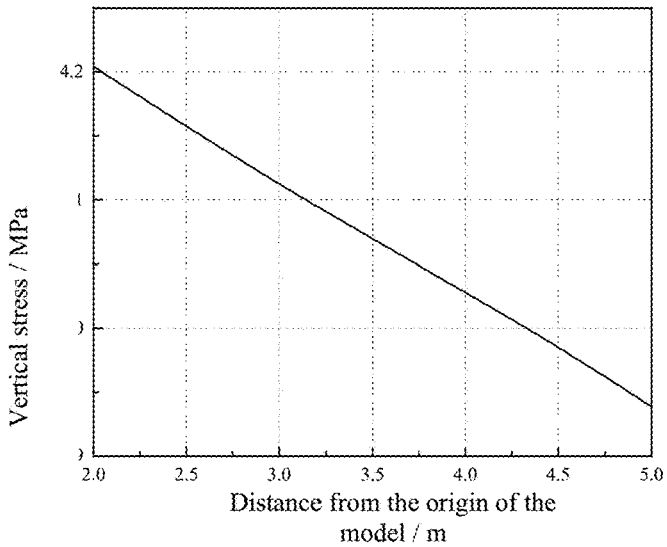
FIG. 6 is a compression curve chart of the cement filling material wall according to the present disclosure.

The above solution is applied on the basis of the geologic conditions in a coal mine in the Northwest region of China. In the coal mine, the roof thickness is 2 m, the mining height is 4 m, the coal pillar length is 2 m, the room length is 10 m, the elastic modulus of the roof is 0.9 GPa, the foundation coefficient of the cement filling material wall is $1.5\times10^6$ N/m$^3$, the allowable tensile stress of the roof is 2.8 MPa, the ultimate strength of the cement filling material wall is 39 MPa, and the uniformly distributed load is q=2 MPa. According to the equation (v), in the case that the width of the cement filling material wall is 3 m, the distribution of bending moment in the roof is shown in FIG. 5, the maximum tensile stress suffered by the roof is 2.2 MPa, and the roof will not break. A compression curve chart of the cement filling material wall is plotted, as shown in FIG. 6. According to equation (vi), the resultant force applied on the cement filling material wall is 16.2 MPa, and the current reserved width of the filling material wall (3) also meets the ultimate strength theory. Therefore, the cement filling material wall (3) will not break.

The embodiments described above are only preferred embodiments of the present disclosure, and it should be noted that the person skilled in the art can make various improvements and modifications without departing from the principle of the present disclosure, and these improvements and modifications should be deemed as falling in the scope of protection of the present disclosure.

What is claimed is:

1. A method for recovering room-type coal pillars by replacing with external supports, comprising the following steps:

1) casting a cement filling material wall around a room-type coal pillar by hanging bags on a single prop, and reserving a gap in the cement filling material wall;

2) mining the internal room-type coal pillar through the gap in the cement filling material wall, under a condition of supporting the overlaying strata with the cement filling material wall;

3) plugging the gap in the cement filling material wall and filling a cement filling material into the goaf area surrounded by the cement filling material wall, after the mining of the room-type coal pillar is completed;

4) recovering the single prop after the cement filling material is solidified and stabilized.

2. The method for recovering room-type coal pillars by replacing with external supports according to claim 1, wherein the width-to-height ratio of the room-type coal pillar is less than 0.6.

3. The method for recovering room-type coal pillars by replacing with external supports according to claim 1, wherein in the step 1), a mechanical model for the stage in which the overlaying strata is supported solely by the cement filling material wall is established on the basis of the Winkler beam theory, to obtain the displacement and stress condition of the roof in the supporting stage by the cement filling material wall; and the theoretical casting width of the cement filling material wall is obtained according to a first strength theory of roof and a determination criterion for the ultimate strength of the cement filling material wall.

4. The method for recovering room-type coal pillars by replacing with external supports according to claim 1, wherein the width of the cement filling material wall is calculated through the following procedures:

a. sectioning a half plane of the room-type coal pillar for analysis, setting the load of the overlaying strata on the roof as a uniformly distributed load q, the foundation coefficient of the cement filling material wall as k, the spacing between adjacent small room-type coal pillars as c, the width of the cement filling material wall as b, the width of the room-type coal pillar as a and the total width of the room-type coal pillars as 2a, and the differential equation of deflection curve for the segments of the roof in the analyzed area is as follows:

$$\begin{cases} EI\dfrac{d^4\omega_1(x)}{dx^4} = q & x \in [0, a] \\ EI\dfrac{d^4\omega_2(x)}{dx^4} = q - k\omega_2(x) & x \in [a, a+b] \\ EI\dfrac{d^4\omega_3(x)}{dx^4} = q & x \in [a+b, a+b+c] \end{cases} \tag{i}$$

where, EI—flexural rigidity, N/m;

x—distance from any point on the foundation surface to the origin of coordinates in the half plane, m;

$\omega_1(x),\omega_2(x),\omega_3(x)$—deflections of the roof when x is in the segments [0, a], [a, a+b], [a+b, a+b+c] respectively, m;

b. solving the equation (i), setting $$\alpha = \sqrt[4]{\frac{k}{4EI}},$$

to obtain a deflection curve equation of the roof:

$$\begin{cases} \omega_1(x) = \frac{q}{24EI}x^4 + d_1x^3 + d_2x^2 + d_3x + d_4 \\ \omega_2(x) = \frac{q}{k} + d_5e^{-\alpha x}\cos(\alpha x) + d_6e^{-\alpha x}\sin(\alpha x) + \\ \quad d_7e^{\alpha x}\cos(\alpha x) + d_8e^{\alpha x}\sin(\alpha x) \\ \omega_3(x) = \frac{q}{24EI}x^4 + d_9x^3 + d_{10}x^2 + d_{11}x + d_{12} \end{cases} \quad \text{(ii)}$$

where, $d_1$, $d_2$, $d_3$, $d_4$, . . . , $d_{12}$—constant coefficients;

the parameters $d_1$-$d_{12}$ can be obtained according to the condition of continuity and the symmetric boundary condition of the model;

c. obtaining a bending moment equation of the roof by solving the above equations:

$$\begin{cases} M_1(x) = -EI\frac{d^2\omega_1}{dx_2} \\ M_2(x) = -EI\frac{d^2\omega_2}{dx_2} \\ M_3(x) = -EI\frac{d^2\omega_3}{dx_2} \end{cases} \quad \text{(iii)}$$

where, $M_1(x)$, $M_2(x)$, $M_3(x)$—the bending moments of the roof when x is in the segments [0, a], [a, a+b], [a+b, a+b+c] respectively, m;

the reserved width b of the cement filling material wall shall meet the first strength theory of roof and the ultimate strength theory at the same time, i.e., it shall be greater than or equal to a minimum reserved width $b_1$ under the first strength theory of roof and a minimum reserved width $b_2$ under the ultimate strength theory at the same time; specifically, the reserved width b is determined through the following steps d and e:

d. simplifying the roof as a simply supported beam subjected to a uniformly distributed load q on the top and a support load applied in width $b_1$ on the bottom; through analysis, it shows that the maximum bending moment $M_{max}$ suffered by the roof occurs at the side at the center of the beam span offsetting from the bottom support load, at a distance $x_m$=a+$b_1$+3EI·$d_9$/q from the origin of the model, and calculating its value from $M_3(x_m)$ in the equation (iii); then, according to a rectangular section beam theory, calculating the maximum tensile stress of the roof as follows:

$$\sigma_{max} = \frac{6M_{max}}{h^2} \quad \text{(iv)}$$

where, h—height of the roof, m;

according to the first strength theory of roof, in order to prevent the roof from broken, the following criterion should be met:

$$\sigma_{max} \leq [\sigma_1] \quad \text{(V)}$$

where, $[\sigma_t]$—allowable tensile stress on the roof, MPa;

the spacing c between adjacent room-type coal pillars and the width 2a of the room-type coal pillars are known, the minimum reserved width $b_1$ of the reserved coal pillar under the first strength theory of roof can be obtained according to the criterion in the expression (v);

e. besides, the width $b_2$ of the cement filling material wall under the ultimate strength theory shall be enough to prevent the cement filling material wall from broken; thus, according to the ultimate strength theory, the following criterion should be met:

$$\sigma F \leq \sigma_P \quad \text{(Vi)}$$

where, σ—force σ=k=kk$\int_a^{a+b}\omega_2(x)dx$ acting on the filling material wall, m;

k—safety factor, determined as 2;

$\sigma_p$—ultimate strength of the cement filling material wall, MPa;

the minimum reserved width $b_2$ of the cement filling material wall under the ultimate strength theory is calculated on the basis of the expression (vi);

f. calculating the reserved width b of the cement filling material wall as b=max{$b_1$, $b_2$}.

5. The method for recovering room-type coal pillars by replacing with external supports according to claim 1, wherein in the step 2), the room-type coal pillar is mined with a continuous coal miner, and the mined coal is transported by means of a forklift truck to a belt conveyer and then conveyed by the belt conveyer out of the mining area.

6. The method for recovering room-type coal pillars by replacing with external supports according to claim 1, wherein in the step 3), the gap in the cement filling material wall is plugged by building a plugging wall, and the cement filling material is pumped by means of a filling pump through a pumping opening reserved in the plugging wall into the goaf area surrounded by the cement filling material wall for filling.

* * * * *